US007575202B2

(12) United States Patent
Sharkey et al.

(10) Patent No.: US 7,575,202 B2
(45) Date of Patent: Aug. 18, 2009

(54) APPARATUS AND METHODS FOR PROVIDING RELATIVELY CONSTANT WARNING TIME AT HIGHWAY-RAIL CROSSINGS

(75) Inventors: John T. Sharkey, Elgin, IL (US); Richard Bamfield, Nelson (NZ); Martin Paget, Anaheim Hills, CA (US)

(73) Assignee: Safetran Systems Corporation, Louisville, KY (US)

( * ) Notice: Subject to any disclaimer, the term of this patent is extended or adjusted under 35 U.S.C. 154(b) by 668 days.

(21) Appl. No.: 11/250,686

(22) Filed: Oct. 14, 2005

(65) Prior Publication Data

US 2007/0084974 A1 Apr. 19, 2007

(51) Int. Cl.
*B61L 29/00* (2006.01)

(52) U.S. Cl. ..... 246/293; 246/111; 246/125; 246/126; 246/473.1

(58) Field of Classification Search ..... 246/111, 246/113, 121, 114 R, 122 R, 125, 126, 128, 246/130, 292, 293, 473.1; 340/917, 933; 701/19

See application file for complete search history.

(56) References Cited

U.S. PATENT DOCUMENTS 6,830,224 B2 * 12/2004 Lewin et al. ..... 246/167 R

OTHER PUBLICATIONS

Invensys—Application Guidelines, Microprocessor Based Grade Crossing Predictor Model 3000 Family.

Safetran Systems Corporation, Instruction & Installation, Solid-State Crossing Controller III Plus (SSCC III Plus) 91190, 91195, Apr. 2004, Document No. SIG-00-02-03, Version D.

Safetran Systems Corporation, Instructions & Installation, Microprocessor Based Grade Crossing Predictor Mode; 3000 Family, Apr. 2002, Document No. SIG-00-00-02, Version B.

* cited by examiner

*Primary Examiner*—Mark T Le
(74) *Attorney, Agent, or Firm*—Cook Alex Ltd.

(57) ABSTRACT

Apparatus, methods and a communication system for providing relatively constant warning time at a rail grade crossing for trains with prediction of the approach of a train from a remote controller via rail-based communications to a crossing controller. A first communication signal is generated when a prediction occurs and a second communication signal is generated for slower moving trains, with the second signal temporarily overriding the first signal to provide relatively constant warning time at the crossing. Cancellation timers with timing intervals are used to resolve situations where the train does not enter the approach or where the train leaves by way of a switch or backs out. Directional logic is used to determine the direction of movement of the train and, in conjunction with cancellation timers, causes the warning devices to be activated when the timers expire.

22 Claims, 2 Drawing Sheets

APPARATUS AND METHODS FOR PROVIDING RELATIVELY CONSTANT WARNING TIME AT HIGHWAY-RAIL CROSSINGS

FIELD OF THE INVENTION

The present invention relates generally to apparatus, methods and communication systems for highway-rail grade crossing warning systems. More particularly, the present invention relates to improved communications apparatus, methods and systems for such crossing warning systems that provide for relatively constant warning time through the use of rail-based communications.

BACKGROUND OF THE INVENTION

A Constant Warning Time (CWT) device is a train detection device for a highway-railroad grade crossing warning system that provides a relatively uniform warning time. The CWT device electrically connects to the track and forms a track circuit between the crossing and a termination shunt located a predetermined distance from the crossing. The distance to the shunt is dependent on the maximum train speed and the desired warning time of the crossing warning system. The CWT device monitors its transceiver signal level on the track and predicts the arrival of a train based on an impedance change caused by the axles of the train as it approaches the crossing.

In highway railroad grade crossing warning systems that utilize CWT, frequently the CWT track circuit at the crossing cannot extend a sufficient distance due to other signal requirements in the approach to the crossing circuit. When this situation is encountered, it is necessary for a remote CWT device to predict the arrival of the train at the distant crossing. A common term in the signal industry for the remote CWT prediction is "DAX", meaning control of a Downstream Adjacent Crossing (Xing).

Conventionally, the DAXing control information is conveyed between the locations via buried cable. When the train reaches a prediction point in the DAX approach, the remote unit will de-energize its DAX output circuit, which is communicated via the cable circuit to an input on the CWT device at the crossing. The input on the CWT device at the crossing is commonly known by the acronym "UAX" input since it generally came from an Upstream Adjacent Xing.

A general object of the present invention is to improve the constant warning time provided by highway-rail grade crossing warning systems through the use of rail-based communications.

Another object of the present invention is to improve the relatively constant warning time provided at a highway-rail grade crossing warning system where a remote device predicts the arrival of a train at the crossing and communicates the prediction through the use of rail-based communications.

A further object of the present invention is to provide improved communication between a remote device and a highway-rail grade crossing warning system for prediction.

Yet another object of the present invention is to provide a first signal to predict the approach of a train to the highway-rail grade crossing and a second signal that overrides the first signal, if a slow moving train is detected, to prevent the crossing warning system from being activated too early.

Another object of the present invention is to provide directional logic that can determine the direction of motion of a train after it has stopped and then resumes motion.

A still further object of the present invention is to provide methods for communicating between a remote device and a highway-rail grade crossing warning system for prediction of trains by rail-based communications.

SUMMARY OF THE INVENTION

One aspect of this invention is directed to apparatus for providing a relatively constant warning time at a highway-rail grade crossing through the use of rail-based communications. The apparatus includes a crossing controller for monitoring a track of the rail grade crossing, a warning device that is actuated by the crossing controller when an approaching train is predicted by the crossing controller, a remote controller for sensing the approach of a train, the remote controller communicating the approach of a train to the crossing controller. The remote controller also determines if the approaching train is a slower moving train and communicates any determination that the train is slower moving to the crossing controller, the crossing controller responds to the communication that the train is slower moving by preventing activation of the warning device too early.

A transmitter associated with the apparatus generates a first communication signal, the first communication signal changes when an approaching train is sensed by the remote controller, the change in the first communication signal is communicated via rail-based communications to a receiver which is in communication with the crossing controller, and the crossing controller responds to the change in the first communication signal to activate the warning device. The transmitter also generates a second communication signal, the second communication signal changes when the approaching train is determined by the remote controller to be a slower moving train, the change in the second communication signal is communicated via rail-based communications to the receiver which is in communication with the crossing controller, and the crossing controller responds to the change in the second communication signal to prevent activation of the warning device too early. For example, the first and second communication signals may both be different audio frequency communication signals. Preferably, the first communication signal is normally energized and becomes de-energized when the remote controller senses the approach of a train and communicates that to the crossing, and the second communication signal is normally de-energized and the second communication signal becomes energized when the remote controller senses the approach of a slower train and communicates that to the crossing, thereby causing the crossing controller to temporarily bypass the de-energized first communication signal.

Preferably, the apparatus also includes a first timer to provide a first predetermined time delay, the first timer initiated after the second communication signal is energized, and if the first communication signal does not remain de-energized for the length of the first predetermined time delay, temporary bypass of the first communication signal is terminated and the crossing controller activates the warning device. A second timer may provide a second predetermined time delay greater than the first predetermined time delay, the second timer is initiated after the second communication signal is energized, and if the first communication signal does not remain de-energized after the second predetermined time delay or if a track signal monitored by the crossing controller exceeds a predetermined level indicative of a train on a monitored portion of the track, the crossing controller deactivates the warning device.

The apparatus further includes directional logic. The directional logic determines that motion of a train is in an outbound direction if the crossing controller determines that the magnitude of track circuit signal is indicative of the train being near the island and if the crossing controller subsequently determines that an island circuit is de-energized. The directional logic then overrides de-energization of the first communication signal and deactivates the warning device. The directional logic continues to remain in an outbound state as long as outbound motion of the train continues to be detected. A cancellation timer with a first predetermined cancellation time cancels the outbound state of the directional logic if the crossing controller senses a relatively large track signal magnitude, if no outbound motion of the train is detected and if the first communication signal is de-energized at the end of the first predetermined cancellation time. The cancellation timer also has a second predetermined cancellation time and cancels the outbound state of the directional logic if the crossing controller senses that the train stopped on the outbound move for a time greater than the second predetermined time and if the first communication signal is de-energized at the end of the second predetermined cancellation time.

Yet another aspect of the present invention includes related methods. One of the methods includes the steps of monitoring a track of the rail grade crossing with the crossing controller, actuating a warning device with the crossing controller when an approaching train is predicted by the crossing controller, sensing the approach of a train at the remote controller, communicating the approach of a train from the remote controller to the crossing controller via a track circuit, determining if the approaching train is a slower moving train at the remote controller, communicating via the track circuit any determination that the train is slower moving to the crossing controller, and responding to the communication that the train is slower moving by preventing early activation of the warning device for slower moving trains.

Additional methods include the steps of providing a first communication signal via a track circuit, changing the first communication signal when an approaching train is sensed by the remote controller, communicating the change in the first communication signal to the crossing controller, responding to the change in the first communication signal at the crossing controller to activate the warning device, providing a second communication signal via a track circuit, changing the second communication signal when the approaching train is determined by the remote controller to be a slower moving train, communicating the change in the second communication signal to the crossing controller, and responding to the change in the second communication signal at the crossing controller to delay activation of the warning device for slower moving trains. Further steps include normally energizing the first communication signal, normally de-energizing the first communication signal, de-energizing the second communication signal when the remote controller senses the approach of a train, energizing the second communication signal when the remote controller senses the approach of a train, and using the energization of the second communication signal to temporarily bypass the de-energization of the first communication signal at the crossing controller, thereby delaying activation of the warning device for slower moving trains.

The present invention is further directed to methods including the steps of providing a first timer with a first predetermined time delay, initiating the first timer after the second communication signal is energized, terminating temporary bypass of the first communication signal if the first communication signal does not remain de-energized for the length of the first predetermined time delay, and activating the warning device if the first communication signal does not remain de-energized for the length of the first predetermined time delay. Preferably, the steps also include providing a second timer with a second predetermined time delay greater than the first predetermined time delay, initiating the second timer after the second communication signal is energized, and activating the warning device if the first communication signal does not remain de-energized after the second predetermined time delay or if a track signal monitored by the crossing controller exceeds a predetermined level indicative of a train on a monitored portion of the track.

Preferably the methods include the steps of providing directional logic, determining that motion of a train is in an outbound direction if the crossing controller determines that the magnitude of a track circuit signal is indicative of the train being near the island and if the crossing controller subsequently determines that an island circuit is de-energized, using the directional logic to override the first communication signal if the first communication signal does not remain de-energized for the length of the first predetermined time delay, deactivating the warning device, and continuing to keep the directional logic in an outbound state as long as outbound motion of the train continues to be detected. Still another method provides a cancellation timer with a first predetermined cancellation time, cancels the outbound state of the directional logic if the crossing controller senses a relatively large track signal magnitude, if no outbound motion of the train is detected and if the first communication signal is de-energized at the end of the first predetermined cancellation time, provides the cancellation timer with a second predetermined cancellation time, and cancels the outbound state of the directional logic if the crossing controller senses that the train stopped on the outbound move for a time greater than the second predetermined time and if the first communication signal is de-energized at the end of the second predetermined cancellation time.

The present invention further includes a communication system for apparatus for providing relatively constant warning time for a rail-grade crossing. The apparatus includes a crossing controller, a remote controller and a warning device. The communication system includes a first transmitter for transmitting a first communication signal via rail-based communications, the first communication signal changes when an approaching train is sensed by the remote controller, the change in the first communication signal is communicated to the crossing controller, and the crossing controller responds to the change in the first communication signal to activate a warning device. A second transmitter in the communication system transmits a second communication signal via rail-based communications, the second communication signal changes when the approaching train is determined by the remote controller to be a slower moving train, the change in the second communication signal is communicated to the crossing controller, and the crossing controller responds to the change in the second communication signal to prevent early activation of the warning device.

The first and second communication signals in the communication system are preferably audio signals of different frequencies. The communication system further includes a first receiver for receiving the first communication signal via rail-based communications, and a second receiver for receiving the second communication signal via rail-based communications, and the first and second receivers are in communication with an input of the crossing controller. The first communication signal is normally energized and said first communication signal becomes de-energized when the remote controller senses the approach of a train. The second communication signal is normally de-energized and the second communication signal becomes energized when the remote controller senses the approach of a slower train, thereby causing the crossing controller to temporarily bypass the de-energization of the first communication signal.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which.

DESCRIPTION OF THE PREFERRED EMBODIMENTS

It will be understood that the invention may be embodied in other specific forms without departing from the spirit thereof. The present examples and embodiments, therefore, are to be considered in all respects as illustrative and not restrictive, and the invention is not to be limited to the details given herein.

Figure 1:
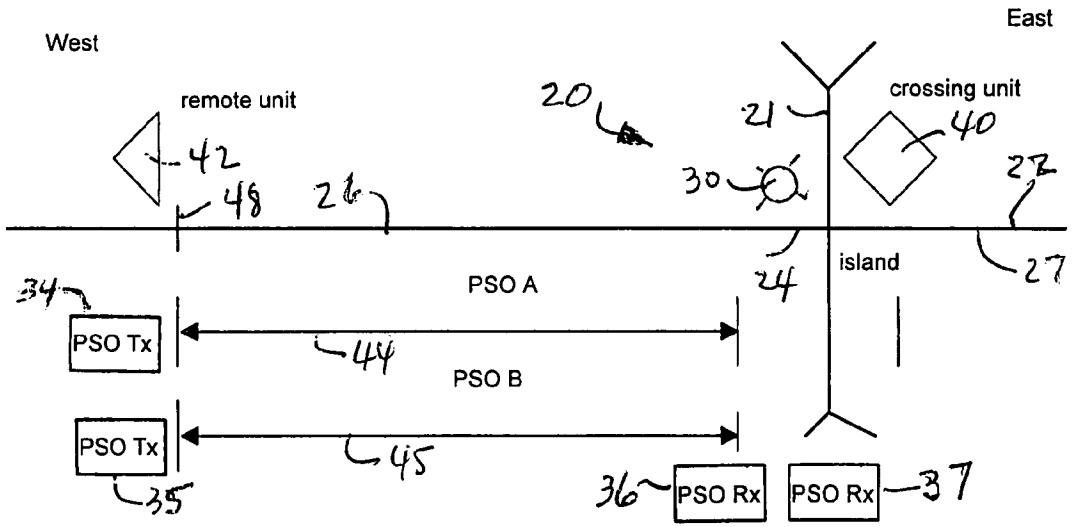
FIG. 1 is a diagrammatic illustration of a highway-rail grade crossing including a warning system that communicates between a remote controller and a crossing controller in accordance with the present invention.

With reference to the drawing Figures, FIG. 1 illustrates a highway-rail crossing, generally indicated by reference numeral 20, at the intersection of a road 21 and a railroad track 22. A Grade Crossing Predictor (GCP) system 40 is in general proximity to railroad track 22. The GCP system 40 will also be hereinafter referred to as a controller or a crossing controller. The GCP system or controller 40 is an integrated system that includes all of the control, train detection, and monitoring of a highway-railroad grade crossing warning system, such as for the highway-rail crossing 20 shown in FIG. 1. The railroad grade crossing shown in FIG. 1 may include a plurality of tracks, instead of the single track 22 shown. Likewise, controller 40 may monitor and control a plurality of tracks; for example, typically up to six tracks.

In a conventional manner, at least that portion of railroad track 22 that intersects with the road 21 includes an island circuit 24 that is monitored by controller 40. Similarly, those portions of track 22 that lie to the right and to the left of the island circuit 24 are included in an approach circuit are identified by reference numerals 27 and 26, respectively. Approach circuits 26 and 27 are also monitored by the controller 40. Traffic warning devices 30 are typically placed on both sides of track 22 and adjacent to road 21. Warning devices 30 are provided with flashing lamps, and may be provided with gates that may be lowered, and/or may be provided with audible devices, such as bells, or the like, in a known manner. When a train is detected in the approach circuits 26 and 27 or in the island circuit 24, controller 40 activates the traffic warning device 30.

The present invention in the GCP system 40, utilizes audio frequency track circuit technology to communicate the DAX information from a remote controller 42 to the crossing controller 40 at the crossing via rail-based communications. Audio frequency track circuits utilize a transmitter connected across the rails that, when 'keyed-on', communicates an electrical signal to a receiver connected to the track at another location. The receiver is de-energized whenever the transmitter is off, or when a train is shunting the track circuit between the transmitter and receiver. When train axles are in the approach circuit 26, the axles form a short circuit across the track that shunts the transmitted signal away from the receiver.

In accordance with one aspect of the present invention, the remote controller 42 keys a first phase shift overlay (PSO) transmitter 34 and a second PSO transmitter 35. A first PSO receiver 36 receives the PSO signals from the first transmitter 34, and a second PSO receiver 37 receives the PSO signals from the second transmitter 35. These PSO signals are typically of different audio frequencies. Receivers 36 and 37 provide output signals to the crossing controller 40, which is located at the crossing 20. For example, the output signal from PSO receivers 36 and 37 may be received at a UAX input of controller 40.

Crossing controller 40 also monitors its transceiver signal level on the track 26, which is referred to as the EZ level. This EZ level is nominally 100 without a train in the approach. As a train approaches the crossing 20, the EZ level reduces nearly proportional to the distance that the train is from the crossing.

Advanced analysis of the track circuit is required to provide fail-safe directional detection of the train, which allows deactivation of the warning devices 30 for receding trains. One of the aspects of the present invention is the reactivation of the warning devices 30 if a train stops after proceeding over the crossing 20 and then reverses direction back towards the crossing.

In accordance with another aspect of the present invention, two PSO transmitters 34 and 35 are located near the remote location of remote controller 42 and two PSO receivers 36 and 37 are located near crossing controller 40. For example, the first PSO transmitter 34 may generate PSO signal A, also indicated by reference numeral 44, and the second PSO transmitter 35 may generate PSO signal B, also indicated by reference numeral 45. Transmitters 34 and 35 may be combined together, if desired. Each PSO track circuit operates on a different frequency. In the following example, these frequencies are referred to as an A signal 44 and a B signal 45. In a similar manner, a first PSO receiver 36 may receive the A signal 44 and a second PSO receiver 37 may receive the B signal 45. PSO receivers 36 and 37 are in communication with crossing controller 40, such as with a UAX input of crossing controller 40.

At the point at which the remote controller 42 would normally de-energize its DAX relay drive output, it will vitally drop the transmit signal for the PSO A signal 44. The crossing controller 40 will treat the lack of a PSO A received signal 44 as an indication to activate the crossing warning devices 30. This DAXing scheme works fine for trains that always predict further out than the remote controller 42, but it will lead to long warning times for slower trains that do not need to activate the warning system 30 until they are well into the approach of the track circuit 26 at the crossing. This occurs because the PSO receive signal will always drop out (be shunted out) as soon as the train passes the insulated rail joints 48 near the remote controller 42 and thus will cause the crossing to activate. In some applications, where trains are generally constant speed and fast, this may be an acceptable approach.

Figure 2:
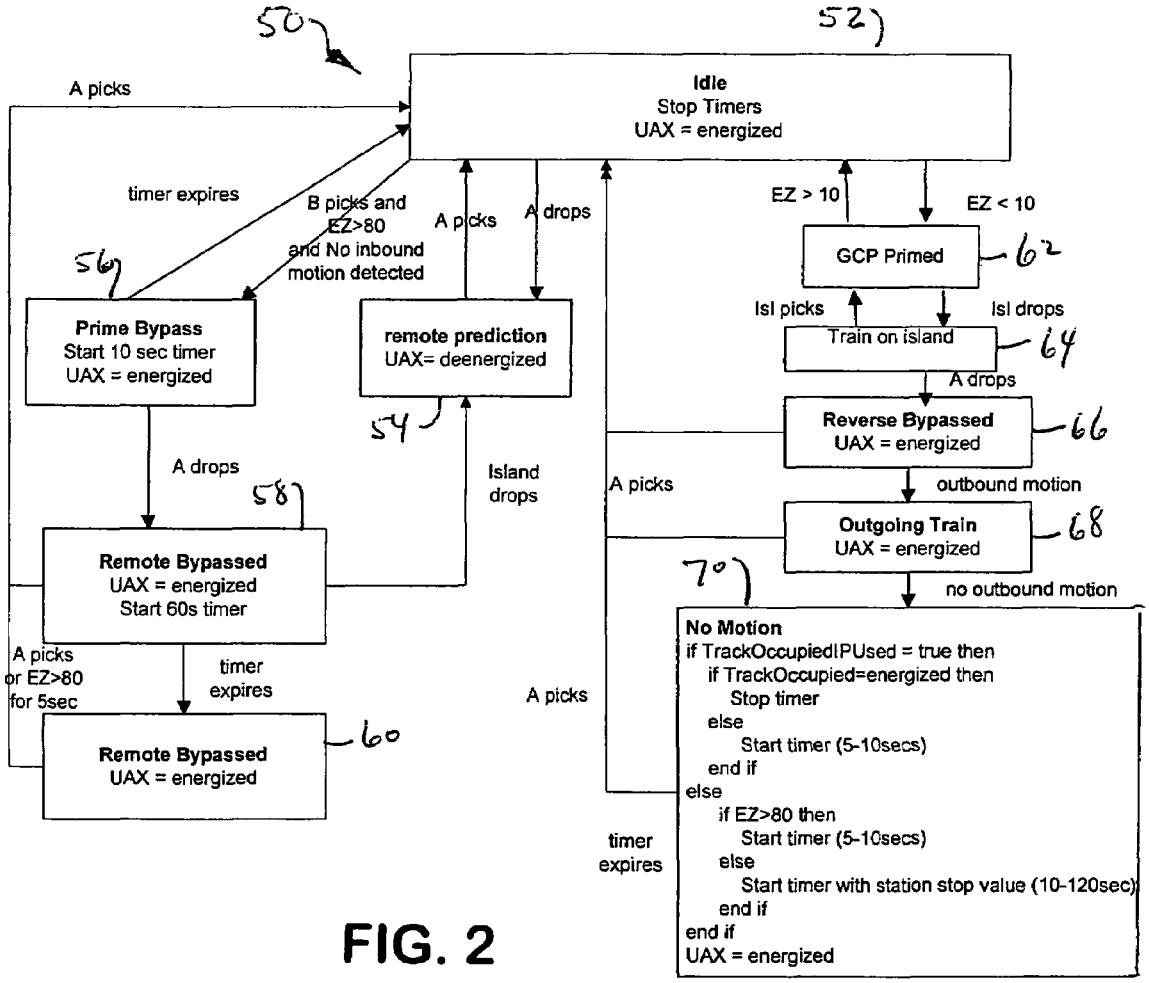
FIG. 2 is a state transition model diagram that illustrates representative steps that may occur during communication between the remote controller and the crossing controller in accordance with the present invention.

The state transition model diagram in FIG. 2 illustrates the steps of modifying the response of crossing controller 40 during the approach of slower trains. In block 50, crossing controller 40 is in an idle state, the various timers are stopped and the UAX signal input to controller 40 is energized. When a remote prediction of an approaching train is made at block 54, the A signal 44 drops as the train crosses the insulated joints 48. The dropping of the A signal 44 is detected by PSO receiver 36, which is in communication with crossing controller 40. At the same time, the UAX signal to controller 40 is de-energized. Crossing controller 40 then activates the warning devices 30 to warn of the approaching train.

However, to avoid long warning times at the rail-highway grade crossing for slower trains, a second PSO B signal 45 is needed to tell the crossing to ignore the dropping out of the PSO A signal 44 as the train passes the insulated joints 48. When conventional PSO circuits are being used, this will require a second PSO (PSO B signal 45), as illustrated in FIG. 1. If the remote controller 42 computes that the train is not going to predict within about the first 5 seconds after passing the insulated joints 48, then the remote controller 42 will activate the transmitter 34 to energize PSO signal B, which is normally deactivated, but just prior to the train arriving at the insulated joints 48. When the input of controller 40 at the crossing sees PSO signal B energized, it will know to ignore or override the de-energizing of PSO signal A. For example, the 5 second overlap may compensate for the reaction time of the crossing controller 40. This overlap time will lead to warning time up to about 5 seconds longer for trains that predict about 5 seconds after passing the insulated joint 48.

The crossing logic also needs to prevent situations in which the DAXing is bypassed by PSO signal B 45 but not cleared by the train going through the island, such as:

a) PSO signal A 44 does not drop on this train move, due to the train not entering the block, or b) PSO signal A 44 drops, but the train leaves the crossing approach via a switch or the train backs out.

Thus, to solve situation a), a 10 second timer is started after PSO signal B 45 picks. This is seen in block 56 of FIG. 2. If PSO signal A 44 does not drop in this time, bypass is not allowed. However, if signal A 44 drops, bypass occurs and the UAX input to controller 40 remains energized (block 58 in FIG. 2).

In order to solve situation b), the bypass is ended if the EZ level goes above 80. However, a timer is needed to prevent the bypass being canceled as the train first enters the approach. Hence, a 60 second timer is started when PSO signal A 44 first drops (block 58 in FIG. 2). When the 60 second timer expires (block 60), the remote remains bypassed and the UAX input to controller 40 remains energized. If signal A 44 returns or if the EZ level is greater than 80 for about 5 seconds, the process returns to the idle block 52 in FIG. 2.

As can be appreciated, if a more sophisticated PSO transmitter is used that can convey more than 1 bit of information, for instance being able to dynamically switch between transmitting one or two code signatures, and if the PSO receiver can distinguish between these codes, then a single PSO transmitter could be used instead of a separate PSO transmitter for signal A 44 and a separate PSO transmitter for signal B 45.

The present invention also performs directional logic to prevent activation on the reverse move, such as a train moving from the crossing on the island 24 toward the remote controller 42. In this situation, if controller 40 sees a low EZ level such as less than 10 (block 62 in FIG. 2), then the island circuit is de-energized (block 64), and de-energization of PSO signal A is ignored (block 66), motion in an outward direction from the island 24 is determined (block 66). The outbound move logic will be set once the island energizes (block 68) and as long as outward motion is being sensed (block 70). As further shown in block 70, an outbound motion cancellation timer is used to cancel the outbound motion logic in either of two conditions:

a) The train leaves the approach (EZ>80 and no outbound motion is sensed), the cancellation timer is started with a time interval of about 5 to 10 seconds. After this time, if PSO signal A 44 is still down, the crossing controller 40 will activate.

b) A train stops on the outbound move, the outbound motion stops. A cancellation timer is started with a configurable time of up to 120 seconds, which is equivalent of the station stop time used in the enhanced detection. After this time, if PSO signal A is still de-energized, the crossing controller 40 will activate the warning devices 30. If outbound motion restarts, the timer will be canceled. It should be noted that the outbound motion logic only overrides the PSO signal A circuit. If the stopped train were to reverse and approach the crossing while the outbound logic is set, the normal prediction process would occur and activate the warning devices 30 at the crossing 20.

The timers used above may not adequately cover all situations. For example, if a train transverses the crossing but stops on the receding circuit for a red signal just short of the insulated joints, then the train may stop for a long period waiting for a proceed signal. The outbound logic cancellation timer will have expired and the crossing would be activated. In order to prevent this situation, the present invention has provision for the controller 40 at the crossing to have a track occupied input that can be driven from the signaling systems track circuit information. Hence, the train can stay on the approach indefinitely and the crossing will not activate unless it reverses direction and approaches the crossing. For safety reasons, this input should be inverted. Thus, if the wayside system track circuit de-energizes, it energizes the track occupied input. While the track occupied input is energized, the crossing unit will not start the outbound motion cancellation timer. Therefore, under a failure condition of this input, the outbound motion cancellation timer is allowed to run.

Figure 3:
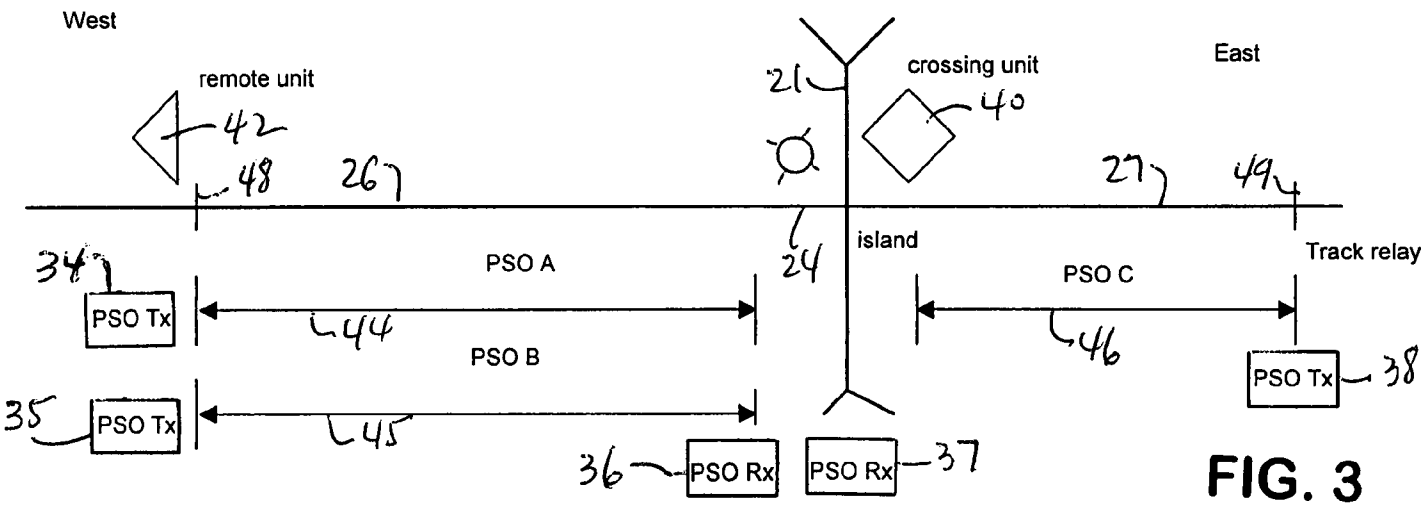
FIG. 3 is a diagrammatic illustration of a highway-rail grade crossing with a warning system that is related to the warning system in FIG. 1, except that the embodiment shown in FIG. 3 includes a third transmitter for bi-directional circuits.

Typically, the crossing unit will be a bi-directional installation, and thus have no insulated joints 48. Hence, the track circuit information is not usually available at this location. A third PSO 38 could be used to bring this information in, as shown in FIG. 3. If the track relay is down, PSO signal C 46 at the signal location will be up.

Figure 4:
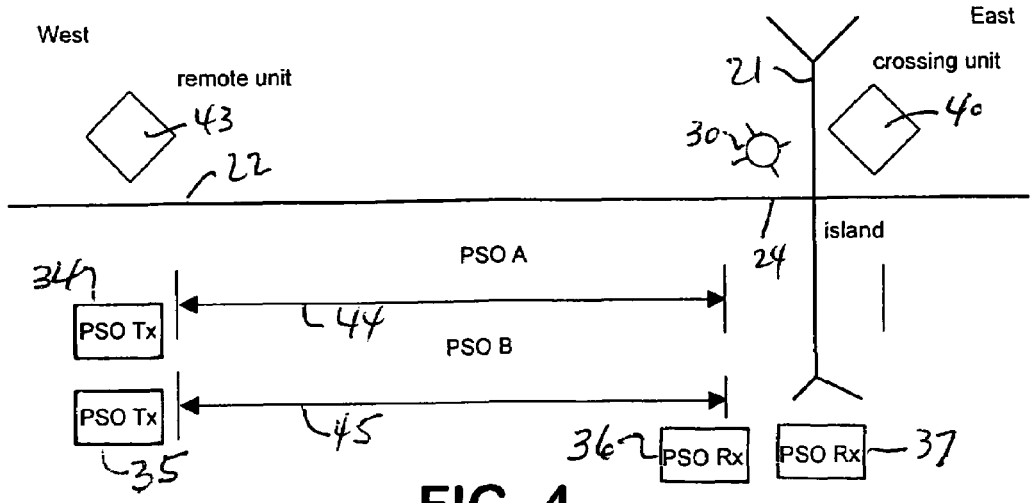
FIG. 4 is a diagrammatic illustration of a highway-rail grade crossing with a warning system that is related to the warning system in FIG. 1, except that the embodiment shown in FIG. 4 includes a bi-directional remote controller.

Since PSO signal A 44 is used to establish direction, the application will work just as well if the remote controller 42 were a bi-directional controller 43 with no insulated joints as shown in FIG. 4.

While particular embodiments of the invention have been shown and described, it will be obvious to those skilled in the art that changes and modifications may be made therein without departing from the invention in its broader aspects.

The invention claimed is:

1. Apparatus for providing relatively constant warning time at a rail grade crossing for trains, said apparatus comprising:

a crossing controller for monitoring a track of the rail grade crossing;

a warning device that is actuated by the crossing controller when an approaching train is predicted by the crossing controller;

a remote controller for sensing the approach of a train, said remote controller communicating the approach of a train to said crossing controller via rail-based communications, wherein said remote controller also determines if the approaching train is a slower moving train and communicates any determination that the train is slower moving to said crossing controller via rail-based communications, and said crossing controller responds to the communication that the train is slower moving by preventing early activation of said warning device;

a first transmitter for transmitting a first communication signal via rail-based communications, said first communication signal changing when an approaching train is sensed by the remote controller, a first receiver for receiving the first communication signal via rail-based communications, the first receiver for communicating the change in the first communication signal to the crossing controller, said crossing controller responding to the change in the first communication signal to activate the warning device;

a second transmitter for transmitting a second communication signal via rail-based communications, said second communication signal changing when the approaching train is determined by the remote controller to be a slower moving train;

a second receiver for receiving the second communication signal via rail-based communications, the second receiver communicating the change in the second communication signal to the crossing controller; and said crossing controller responding to the change in the second communication signal to prevent early activation of the warning device.

2. The apparatus in accordance with claim 1, said first and second communication signals are audio signals of different frequencies.

3. The apparatus in accordance with claim 1, wherein said first communication signal is normally energized and said first communication signal becomes de-energized when said remote controller senses the approach of a train.

4. The apparatus in accordance with claim 3, wherein said second communication signal is normally de-energized and said second communication signal becomes energized when said remote controller senses the approach of a slower train, thereby causing the crossing controller to temporarily bypass the de-energization of the first communication signal.

5. The apparatus in accordance with claim 4, said apparatus further comprising:

a first timer providing a first predetermined time delay, said first timer initiated after the second communication signal is energized, and if the first communication signal does not remain de-energized for the length of the first predetermined time delay, temporary bypass of the first communication signal is terminated and the crossing controller activates the warning device.

6. The apparatus in accordance with claim 5, said apparatus further comprising:

a second timer providing a second predetermined time delay greater than the first predetermined time delay, said second timer initiated after the second communication signal is energized, and if the first communication signal does not remain de-energized after the second predetermined time delay or if a track signal monitored by the crossing controller exceeds a predetermined level indicative of a train on a monitored portion of the track, the crossing controller deactivates the warning device.

7. The apparatus in accordance with claim 1, said apparatus further comprising:

directional logic, said directional logic determining that motion of a train is in an outbound direction if said crossing controller determines that the magnitude of a track circuit signal is indicative of the train being near the island and if the crossing controller subsequently determines that an island circuit is de-energized, said directional logic overrides de-energization of the first communication signal and deactivates the warning device.

8. The apparatus in accordance with claim 7, said directional logic continues to remain in an outbound state as long as outbound motion of the train continues to be detected.

9. The apparatus in accordance with claim 7, said apparatus further comprising:

a cancellation timer with a first predetermined cancellation time, said cancellation timer canceling the outbound state of the directional logic if the crossing controller senses a relatively large track signal magnitude, if no outbound motion of the train is detected and if the first communication signal is de-energized at the end of the first predetermined cancellation time.

10. The apparatus in accordance with claim 7, said apparatus further comprising:

said cancellation timer having a second predetermined cancellation time, said cancellation timer canceling the outbound state of the directional logic if the crossing controller senses that the train stopped on the outbound move for a time greater than the second predetermined time and if the first communication signal is de-energized at the end of the second predetermined cancellation time.

11. In apparatus for providing relatively constant warning time for a rail-grade crossing, said apparatus including a crossing controller, a remote controller and a warning device, a method comprising the steps of:

monitoring a track of the rail grade crossing with the crossing controller;

sensing the approach of a train at the remote controller;

communicating the approach of a train from the remote controller to said crossing controller via rail-based communications; and actuating a warning device with the crossing controller when an approaching train is communicated to the crossing controller;

determining if the approaching train is a slower moving train at the remote controller;

communicating any determination that the train is slower moving to said crossing controller via rail-based communications;

responding to the communication that the train is slower moving by preventing early activation of said warning device;

transmitting a first communication signal via rail-based communications;

receiving the transmitted first communication signal via rail-based communications;

communicating the received first communication signal to the crossing controller;

changing the first communication signal when an approaching train is sensed by the remote controller;

communicating the change in the first communication signal to the crossing controller;

responding to the change in the first communication signal at the crossing controller to activate the warning device;

transmitting a second communication signal via rail-based communications;

receiving the transmitted second communication signal via rail-based communications;

communicating the received second communication signal to the crossing controller;

changing the second communication signal when the approaching train is determined by the remote controller to be a slower moving train;

communicating the change in the second communication signal to the crossing controller; and responding to the change in the second communication signal at the crossing controller to prevent early activation of the warning device for slower moving trains.

12. The method in accordance with claim 11, said method further comprising the steps of:

using the change in the second communication signal to temporarily bypass the first communication signal at the crossing controller.

13. The method in accordance with claim 11, said method further comprising the steps of:

providing a first timer with a first predetermined time delay;

initiating the first timer after the second communication signal is energized;

terminating temporary bypass of the first communication signal if the first communication signal does not remain de-energized for the length of the first predetermined time delay; and activating the warning device if the first communication signal does not remain de-energized for the length of the first predetermined time delay.

14. The method in accordance with claim 13, said method further comprising the steps of:

providing a second timer with a second predetermined time delay greater than the first predetermined time delay;

initiating the second timer after the second communication signal is energized; and activating the warning device if the first communication signal does not remain de-energized after the second predetermined time delay or if a track signal monitored by the crossing controller exceeds a predetermined level indicative of a train on a monitored portion of the track.

15. The method in accordance with claim 13, said method further comprising the steps of:

providing directional logic;

determining that motion of a train is in an outbound direction if said crossing controller determines that the magnitude of a track circuit signal is indicative of the train being near the island and if the crossing controller subsequently determines that an island circuit is de-energized;

using the directional logic to override the first communication signal if the first communication signal does not remain de-energized for the length of the first predetermined time delay; and deactivating the warning device.

16. The method in accordance with claim 15, said method further comprising the step of:

continuing to keep the directional logic in an outbound state as long as outbound motion of the train continues to be detected.

17. The method in accordance with claim 15, said method further comprising the steps of:

providing a cancellation timer with a first predetermined cancellation time; and canceling the outbound state of the directional logic if the crossing controller senses a relatively large track signal magnitude, if no outbound motion of the train is detected and if the first communication signal is de-energized at the end of the first predetermined cancellation time.

18. The method in accordance with claim 17, said method further comprising the steps of:

providing said cancellation timer with a second predetermined cancellation time; and canceling the outbound state of the directional logic if the crossing controller senses that the train stopped on the outbound move for a time greater than the second predetermined cancellation time and if the first communication signal is de-energized at the end of the second predetermined cancellation time.

19. A communication system for apparatus for providing relatively constant warning time for a rail-grade crossing, said apparatus including a crossing controller, a remote controller and a warning device, said communication system comprising:

a first transmitter for transmitting a first communication signal via rail-based communications, said first communication signal changing when an approaching train is sensed by the remote controller, a first receiver for receiving the first communication signal via rail-based communications, the first receiver communicating the change in the first communication signal to a crossing controller, said crossing controller responding to the change in the first communication signal to activate a warning device a second transmitter for transmitting a second communication signal via rail-based communications, said second communication signal changing when the approaching train is determined by the remote controller to be a slower moving train, a second receiver for receiving the second communication signal via rail-based communications, the second receiver communicating the change in the second communication signal to the crossing controller, and said crossing controller responding to the change in the second communication signal to prevent early activation of the warning device.

20. The communication system in accordance with claim 19, said first and second communication signals are audio signals of different frequencies.

21. The communication system in accordance with claim 19, wherein said first communication signal is normally energized and said first communication signal becomes de-energized when said remote controller senses the approach of a train.

22. The communication system in accordance with claim 19, wherein said second communication signal is normally de-energized and said second communication signal becomes energized when said remote controller senses the approach of a slower train, thereby causing the crossing controller to temporarily bypass the de-energization of the first communication signal.

* * * * *

UNITED STATES PATENT AND TRADEMARK OFFICE

CERTIFICATE OF CORRECTION

PATENT NO. : 7,575,202 B2
APPLICATION NO. : 11/250686
DATED : August 18, 2009
INVENTOR(S) : Sharkey et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 928 days.

Signed and Sealed this

Seventh Day of September, 2010

David J. Kappos

David J. Kappos
*Director of the United States Patent and Trademark Office*